US011505423B2

(12) United States Patent
Shimada et al.

(10) Patent No.: US 11,505,423 B2
(45) Date of Patent: Nov. 22, 2022

(54) MEDIUM LOADING DEVICE AND POST-PROCESSING DEVICE

(71) Applicant: SEIKO EPSON CORPORATION, Tokyo (JP)

(72) Inventors: Chiaki Shimada, Shiojiri (JP); Masaki Miyazawa, Matsumoto (JP); Kei Sadakuni, Shiojiri (JP); Hirohisa Kodaira, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 56 days.

(21) Appl. No.: 17/216,967

(22) Filed: Mar. 30, 2021

(65) Prior Publication Data

US 2021/0309481 A1 Oct. 7, 2021

(30) Foreign Application Priority Data

Apr. 2, 2020 (JP) ..... JP2020-066835

(51) Int. Cl.
*B65H 31/34* (2006.01)
*B65H 31/36* (2006.01)
*B65H 5/06* (2006.01)

(52) U.S. Cl.
CPC ..... *B65H 31/34* (2013.01); *B65H 5/062* (2013.01); *B65H 2511/242* (2013.01)

(58) Field of Classification Search
CPC ..... B65H 31/34; B65H 31/36; B65H 5/062; B65H 2511/242
See application file for complete search history.

(56) References Cited

U.S. PATENT DOCUMENTS

2008/0187383 A1* 8/2008 Yamamoto ..... G03G 15/6538 399/407
2015/0014916 A1* 1/2015 Saito ..... B65H 31/34 271/185
2020/0391965 A1* 12/2020 Nakazawa ..... B65H 31/3045

FOREIGN PATENT DOCUMENTS

JP 2002-249275 A 9/2002
JP 2009-113924 A 5/2009
JP 2009242014 A * 10/2009
JP 2015071465 A * 4/2015

* cited by examiner

*Primary Examiner* — Luis A Gonzalez
(74) *Attorney, Agent, or Firm* — Workman Nydegger

(57) ABSTRACT

A loading unit includes a processing tray, alignment units, and a paddle. In the processing tray, a medium is placed. The alignment units are disposed an interval in a Y direction to align a downstream tip end in a positive A direction of the medium. The paddle moves the medium that has been fed onto the processing tray toward the alignment units. A coefficient of friction of a contact surface of the alignment unit is higher than a coefficient of friction of a front face of the alignment unit, and the contact surface is positioned downstream of the front face in the positive A direction.

20 Claims, 13 Drawing Sheets

MEDIUM LOADING DEVICE AND POST-PROCESSING DEVICE

The present application is based on, and claims priority from JP Application Serial Number 2020-066835, filed Apr. 2, 2020, the disclosure of which is hereby incorporated by reference herein in its entirety.

BACKGROUND

1. Technical Field

The present disclosure relates to a medium loading device and a post-processing device.

2. Related Art

In an image forming device disclosed in JP-A-2009-113924, a sheet on which an image is formed is aligned by being caused to abut against a rear end stopper and then loaded on a tray.

In a post-processing device for a sheet-shaped medium disclosed in JP-A-2002-249275, an end of a sheet is brought into contact with two irregular portions with projections and depressions provided on an end face.

In the image forming device disclosed in JP-A-2009-113924, if a bent medium is caused to abut against the rear end stopper, there is a risk that a tip end of the medium may enter a gap between the tip end of the medium that is already loaded on the tray and the rear end stopper, and the alignment of the ends of the loaded media may be disordered.

Here, in a configuration in which the irregular portions disclosed in JP-A-2002-249275 are provided on the rear end stopper disclosed in JP-A-2009-113924 in order to suppress the entry of the medium, because the tip end of the medium always comes into contact with the irregular portions, when the medium is displaced in the width direction, there is a risk of an increased load as a result of sliding between the medium and the irregular portions.

SUMMARY

In order to solve the problems described above, a medium loading device according to the present disclosure includes a placement unit at which a medium processed by a processing unit is placed, a plurality of alignment units disposed at an interval in a width direction intersecting a feeding direction of the medium to the placement unit, and configured to align a downstream tip end in the feeding direction of the medium fed to the placement unit, and a moving member configured to move, toward the plurality of alignment units, the medium fed to the placement unit. Of the plurality of alignment units, a coefficient of friction of a first alignment surface of one of the alignment units is higher than a coefficient of friction of a second alignment surface of another of the alignment units, the first alignment surface and the second alignment surface being configured to align the medium, and the first alignment surface is positioned downstream of the second alignment surface in the feeding direction.

In order to solve the problems described above, a post-processing device according to the present disclosure includes a placement unit at which a medium processed by a processing unit is placed, a plurality of alignment units disposed at an interval in a width direction intersecting a feeding direction of the medium to the placement unit, and configured to align a downstream tip end in the feeding direction of the medium fed to the placement unit, a moving member configured to move, toward the plurality of alignment units, the medium fed to the placement unit, and a post-processing unit configured to perform post-processing on a plurality of the media placed at the placement unit. Of the plurality of alignment units, a coefficient of friction of a first alignment surface of one of the alignment units is higher than a coefficient of friction of a second alignment surface of another of the alignment units, the first alignment surface and the second alignment surface being configured to align the medium, and the first alignment surface is positioned downstream of the second alignment surface in the feeding direction.

DESCRIPTION OF EXEMPLARY EMBODIMENTS

Figure 1:
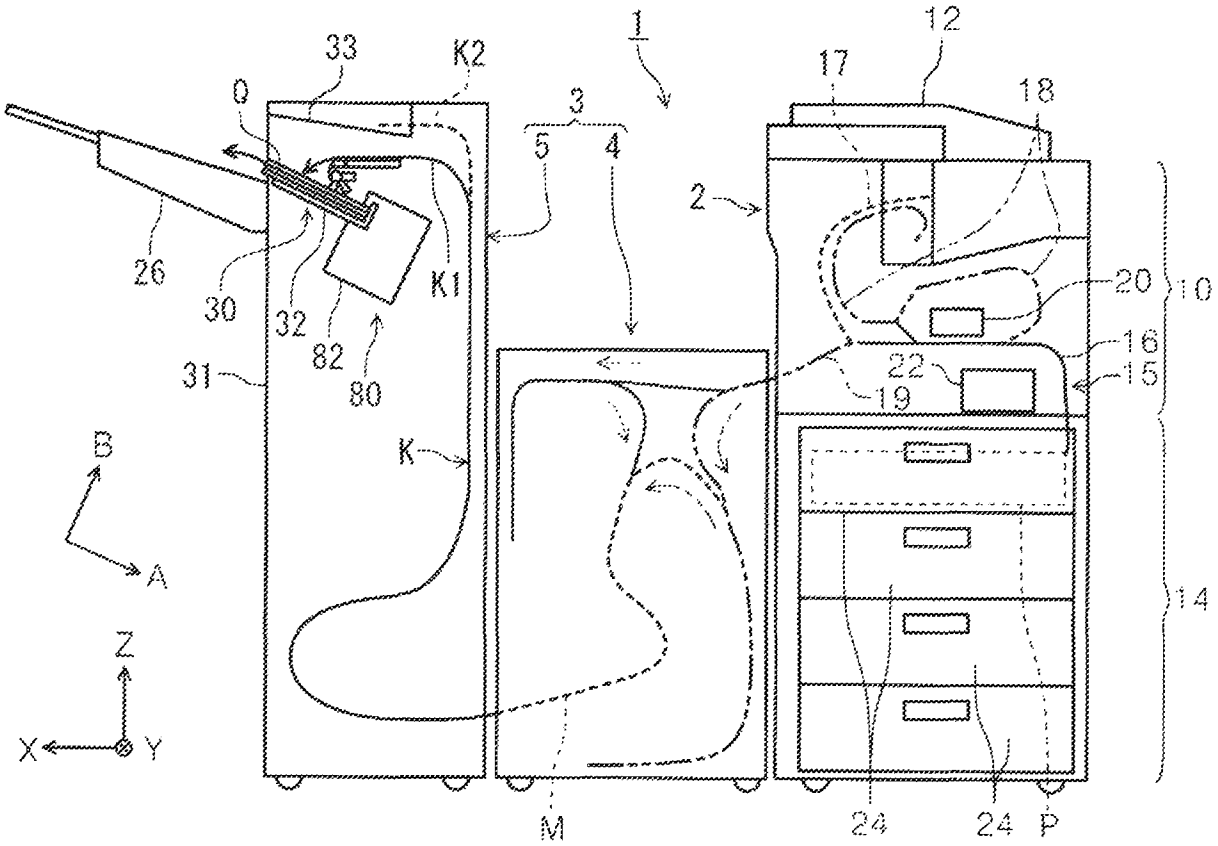
FIG. 1 is a schematic view illustrating an overall configuration of a recording system according to a first embodiment.

The present disclosure will be schematically described below.

A medium loading device according to a first aspect includes a placement unit at which a medium processed by a processing unit is placed, a plurality of alignment units disposed at an interval in a width direction intersecting a feeding direction of the medium to the placement unit, and configured to align a downstream tip end in the feeding direction of the medium fed to the placement unit, and a moving member configured to move, toward the plurality of alignment units, the medium fed to the placement unit. Of the plurality of alignment units, a coefficient of friction of a first alignment surface of one of the alignment units is higher than a coefficient of friction of a second alignment surface of another of the alignment units, the first alignment surface and the second alignment surface being configured to align the medium, and the first alignment surface is positioned downstream of the second alignment surface in the feeding direction.

According to this aspect, the moving member moves, toward the plurality of alignment units, the medium fed to the placement unit. In a state in which at least one of the media is placed on the placement unit, when the other medium in a bent state is fed to the placement unit, since the other one of the alignment units is positioned upstream of the one of the alignment units in the feeding direction, the medium comes into contact with the other one of the alignment units, and the downstream tip end of the medium is aligned.

Subsequently, a portion of the downstream tip end of the medium P, which is not in contact with the second alignment surface, is deformed toward the downstream side in the feeding direction, and at the same time, the portion attempts to move toward the placement unit due to its own weight.

Here, since the downstream tip end of the medium comes into contact with the one of the alignment units positioned downstream of the other one of the alignment units, the movement of the medium toward the downstream is restricted. Furthermore, since the coefficient of friction of the first alignment surface is higher than the coefficient of friction of the second alignment surface, the movement of the downstream tip end of the medium toward the placement unit is restricted. As a result, the downstream tip end of the other medium is inhibited from entering the gap between the downstream tip end of the already loaded medium, and the alignment units. Thus, when the other medium in a bent state is fed to the placement unit, it is possible to inhibit the alignment of the end portions of the already loaded media from becoming disordered.

Further, in a state in which a plurality of the media are loaded on the placement unit, when the plurality of media are displaced in the width direction intersecting the feeding direction, since the first alignment surface having the high coefficient of friction is positioned downstream of the second alignment surface having the low coefficient of friction, the plurality of media are not likely to come into contact with the first alignment surface. As a result, when the plurality of media are displaced in the width direction, it is possible to inhibit a load caused by sliding between the plurality of media and the alignment units from increasing.

In the medium loading device according to a second aspect, with respect to the first aspect, the plurality of alignment units are disposed symmetrically with respect to a center in the width direction.

According to this aspect, at the tip portions in the feeding direction of the plurality of media, the plurality of alignment units uniformly come into contact on both sides of the tip portions with respect to the center in the width direction. Thus, in the placement unit, it is possible to inhibit the plurality of media from being loaded while being inclined with respect to the feeding direction.

In the medium loading device according to a third aspect, with respect to the second aspect, one of the alignment units is disposed in a central portion, in the width direction, of the medium loading device, and another one of the alignment units is disposed on one side and another side, in the width direction, of the one of the alignment units.

According to this aspect, when the medium is fed to the placement unit, portions near both end portions in the width direction of the medium come into contact with the alignment units before portions closer to the central portion thereof. Thus, in the placement unit, it is possible to further inhibit the plurality of media from being loaded while being inclined with respect to the feeding direction.

In the medium loading device according to a fourth aspect, with respect to any one of the first to third aspects, the coefficient of friction of the first alignment surface is higher than the coefficient of friction of the second alignment surface at least in a loading direction of the medium.

According to this aspect, at least in the loading direction, the coefficient of friction of the first alignment surface is higher than the coefficient of friction of the second alignment surface. As a result, the downstream tip end of the medium is inhibited from entering the gap between the downstream tip end of the already loaded medium and the alignment units. Thus, when the medium in a bent state is fed to the placement unit, it is possible to inhibit the alignment of the end portions of the already loaded media from becoming disordered.

In the medium loading device according to a fifth aspect, with respect to any one of the first to fourth aspects, the one of the alignment units includes a friction member including the first alignment surface, and an attachment member to which the friction member is attached.

According to this aspect, when the first alignment surface is worn, it is sufficient that only the friction member be replaced. In other words, since it is not necessary to replace the entire alignment unit, an amount of material to be disposed of when replacing the first alignment surface can be reduced.

In the medium loading device according to a sixth aspect, with respect to any one of the first to fourth aspects, the one of the alignment units includes an alignment unit main body, and the first alignment surface that has a higher coefficient of friction than that of the alignment unit main body and is formed at a portion, of the alignment unit main body, that comes into contact with the medium.

According to this aspect, it is not necessary to configure the entire alignment unit with a member having a high coefficient of friction, and it is sufficient that the first alignment surface be formed by post-processing. Thus, it is possible to prevent portions other than the first alignment surface from unnecessarily having a high coefficient of friction.

In the medium loading device according to a seventh aspect, with respect to any one of the first to sixth aspects, the placement unit includes a displacement member that displaces the medium in the width direction, and at least the one of the plurality of alignment units is fixed to the placement unit.

According to this aspect, when the displacement member displaces the medium in the width direction, the first alignment surface having the high coefficient of friction does not move in the opposite direction to a displacement direction of the medium. Thus, a sliding resistance acting on a contact portion between the medium and the first alignment surface can be reduced.

A post-processing device according to an eighth aspect includes a placement unit at which a medium processed by a processing unit is placed, a plurality of alignment units disposed at an interval in a width direction intersecting a feeding direction of the medium to the placement unit, and configured to align a downstream tip end in the feeding direction of the medium fed to the placement unit, a moving member configured to move, toward the plurality of alignment units, the medium fed to the placement unit, and a post-processing unit configured to perform post-processing on a plurality of the media placed on the placement unit. Of the plurality of alignment units, a coefficient of friction of a first alignment surface of one of the alignment units is higher than a coefficient of friction of a second alignment surface of another of the alignment units, the first alignment surface and the second alignment surface being configured to align the medium, and the first alignment surface is positioned downstream of the second alignment surface in the feeding direction.

According to this aspect, as in the first aspect, when the other medium in a bent state is fed to the placement unit, it is possible to inhibit the alignment of the end portions of the already loaded media from becoming disordered. Further, when the plurality of media are displaced in the width direction, it is possible to inhibit a load caused by sliding between the plurality of media and the alignment units from increasing. Due to these effects, an aligned state of the plurality of media loaded on the placement unit is unlikely to become disordered, and it is thus possible to make it easier for the post-processing unit to perform the post-processing on the plurality of media.

In the post-processing device according to a ninth aspect, with respect to the eighth aspect, the plurality of alignment units are disposed symmetrically with respect to a center in the width direction.

According to this aspect, the same actions and effects as those of the second aspect can be obtained.

In the post-processing device according to a tenth aspect, with respect to the ninth aspect, one of the alignment units is disposed in a central portion, in the width direction, of the post-processing device, and another one of the alignment units is disposed on one side and another side, in the width direction, of the one of the alignment units.

According to this aspect, the same actions and effects as those of the third aspect can be obtained.

In the post-processing device according to an eleventh aspect, with respect to any one of the eighth to tenth aspects, the coefficient of friction of the first alignment surface is higher than the coefficient of friction of the second alignment surface at least in a loading direction of the medium.

According to this aspect, the same actions and effects as those of the fourth aspect can be obtained.

In the post-processing device according to a twelfth aspect, with respect to any one of the eighth to eleventh aspects, the one of the alignment units includes a friction member including the first alignment surface, and an attachment member to which the friction member is attached.

According to this aspect, the same actions and effects as those of the fifth aspect can be obtained.

In the post-processing device according to a thirteenth aspect, with respect to any one of the eighth to eleventh aspects, the one of the alignment units includes an alignment unit main body, and the first alignment surface that has a higher coefficient of friction than that of the alignment unit main body and is formed at a portion, of the alignment unit main body, that comes into contact with the medium.

According to this aspect, the same actions and effects as those of the sixth aspect can be obtained.

In the medium loading device according to a fourteenth aspect, with respect to any one of the eighth to thirteenth aspects, the placement unit includes a displacement member that displaces the medium in the width direction, and at least the one of the plurality of alignment units is fixed to the placement unit.

According to this aspect, the same actions and effects as those of the seventh aspect can be obtained.

First Embodiment

A recording device, a medium loading device, and a post-processing device according to a first embodiment of the present disclosure will be described below with reference to the accompanying drawings.

In FIG. 1, a recording system 1 is illustrated as an example of the recording device. The recording system 1 is configured as an inkjet device for performing recording on a medium P, which is represented by a recording paper, by ejecting ink, which is an example of a liquid.

In an X-Y-Z coordinate system illustrated in each of the drawings, an X direction is a device width direction, a Y direction is a device depth direction, and a Z direction is a device height direction. The X direction, the Y direction, and the Z direction are orthogonal to each other.

When distinguishing left and right in the device width direction, the left is referred to as a positive X direction, and the right is referred to as a negative X direction. When distinguishing between front and back in the device depth direction, the front is referred to as a negative Y direction, and the back is referred to as a positive Y direction. When distinguishing between up and down in the device height direction, up is referred to as a positive Z direction, and down is referred to as a negative Z direction.

The recording system 1 includes a recording unit 2 and a post-processing unit 3 disposed in this order in the positive X direction. Note that the recording system 1 is configured so that the recording unit 2 and the post-processing unit 3 are mechanically and electrically coupled to each other, and the medium P can be transported from the recording unit 2 to the post-processing unit 3.

The recording system 1 is provided with an operating panel (not illustrated) that is operated by an operator. This operating panel is configured to allow input of various settings in the recording unit 2 and the post-processing unit 3. Note that the recording system 1 is configured to perform post-processing, to be described below, on the medium P on which information has been recorded in a printer unit 10 to be described below. In the recording system 1, the same effects as the post-processing unit 3 to be described below are obtained.

The recording unit 2 records various types of information on the transported medium P. A sheet-shaped sheet is used as the medium P, as an example. Further, the recording unit 2 includes the printer unit 10, a scanner unit 12, and a cassette housing unit 14.

The printer unit 10 is an example of a recording portion and a processing unit, and is configured to include a line head 20 and a control unit 22. Further, the printer unit 10 performs recording as an example of processing performed on the medium P.

The line head 20 is configured as a recording head for recording various types of information on the medium P by ejecting the ink onto the medium P.

The control unit 22 is configured to include a central processing unit (CPU) (not illustrated) and a memory (not illustrated) and controls operations such as transporting the medium P in the recording unit 2 and recording the various types of information on the medium P. Further, the control unit 22 can control various operations in the post-processing unit 3, as well as those in the recording unit 2.

The scanner unit 12 reads information of an original document (not illustrated). The information of the original document read by the scanner unit 12 is stored in the memory of the control unit 22.

The cassette housing unit 14 includes a plurality of housing cassettes 24 that accommodate a plurality of the media P. A transport path 15 on which the medium P is transported is formed in the printer portion 10 and the cassette housing unit 14.

As an example, the transfer path 15 includes a paper feed path 16, a discharge path 17, an inversion path 18, and a delivery path 19. Each of the portions of the transport path 15 is provided with a transport roller pair (not illustrated). On the transport path 15, the medium P is transported from the housing cassette 24 to a recording region of the line head 20, and then further transported from the recording region to the post-processing unit 3.

The post-processing unit 3 is an example of the post-processing device. Further, the post-processing unit 3 includes an intermediate unit 4 that transports the medium P received from the recording unit 2, and an end unit 5 that performs post-processing collectively on a required number of the media P received from the intermediate unit 4. In the post-processing unit 3, the same effects as those of the end unit 5 to be described below are obtained.

The intermediate unit 4 is a unit that transports the medium P received from the recording unit 2 and delivers the medium P to the end unit 5. A transport path M is formed in the intermediate unit 4 on which the medium P received from the recording unit 2 is transported.

In the end unit 5, a transport path K is formed on which the medium P from the intermediate unit 4 is transported. As an example, the transport path K includes a main transport path K1 that extends toward a post-processing unit 80 to be described below, and a sub transport path K2 that extends toward an upper tray 33.

The end unit 5 includes a loading unit 30 as an example of the medium loading device, and the post-processing unit 80 that performs the post-processing on the plurality of media P. Further, the end unit 5 includes a housing 31 as a device main body. The housing 31 is configured to include the upper tray 33 and a discharge tray 26. The medium P on which the post-processing is not performed in the post-processing unit 80 is discharged onto the upper tray 33. The medium P on which the post-processing has been performed in the post-processing unit 80 is discharged onto the discharge tray 26.

In the end unit 5, the Y direction is an example of a width direction intersecting a direction in which the medium P is fed onto the loading unit 30. Further, in this embodiment, the direction in which the medium P is fed onto or discharged from the loading unit 30 is referred to as an A direction. As an example, the A direction is a direction orthogonal to the Y direction when viewed from the Z direction, and a direction intersecting the X direction when viewed from the Y direction. Further, the A direction is a direction that is inclined so that the negative X direction is lower than the positive X direction when viewed from the Y direction. A direction orthogonal to the A direction when viewed from the Y direction is referred to as a B direction.

In the following description, with respect to the A direction, a direction in which the medium P moves toward the post-processing unit 80 is referred to as a positive A direction, and a direction in which the medium P moves away from the post-processing unit 80 is referred to as a negative A direction. The positive A direction is an example of a feeding direction. Further, with respect to the B direction, a direction in which the media P are stacked on top of each other is referred to as a positive B direction, and a direction opposite to the positive B direction is referred to as a negative B direction.

Figure 2:
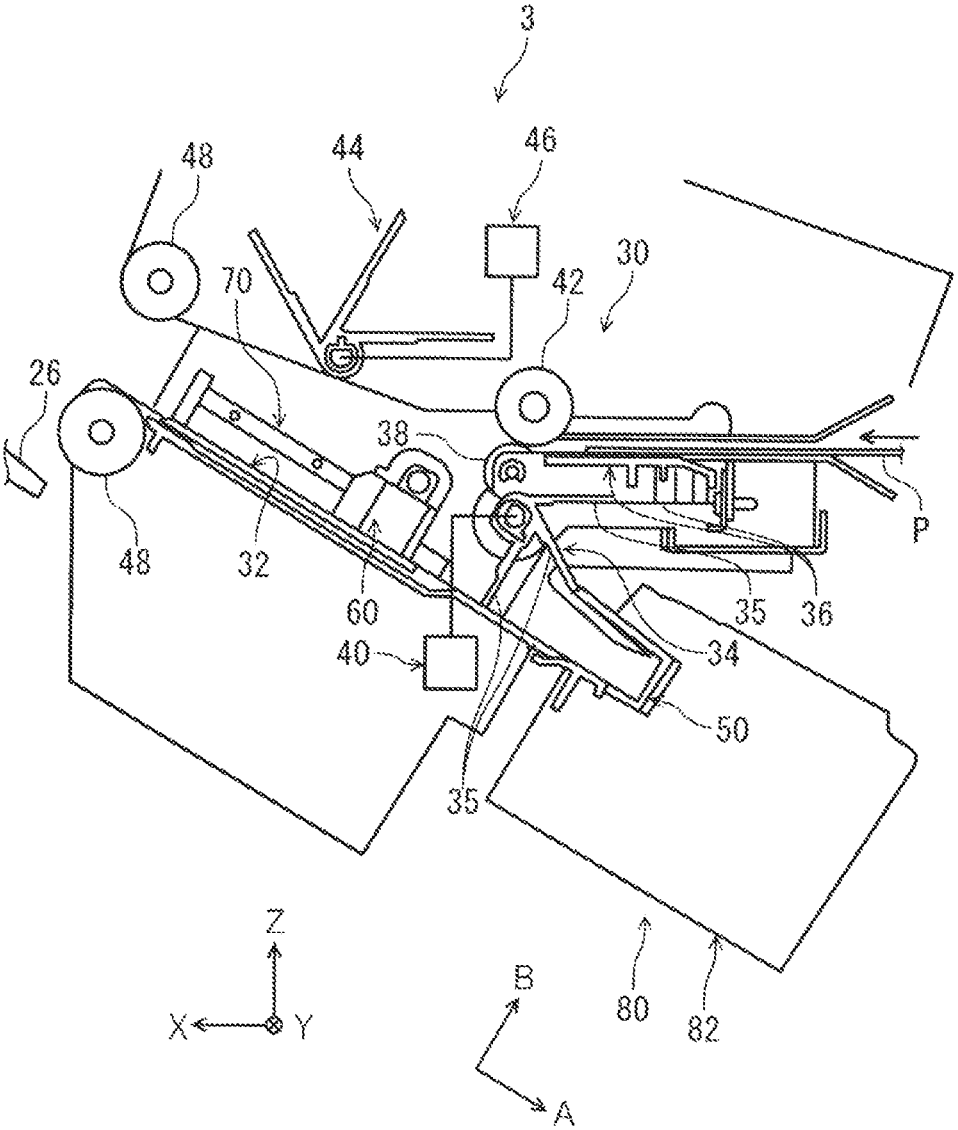
FIG. 2 is a schematic view illustrating a processing tray and peripheral portions of the recording system according to the first embodiment.

The loading unit 30 illustrated in FIG. 2 includes a processing tray 32, an alignment processing unit 50, and a paddle 34. Further, the loading unit 30 is provided with a lower guide member 36, a transport roller 38, a driving unit 40, an auxiliary roller 42, side cursors 70, an auxiliary paddle 44, an auxiliary driving unit 46, and a delivery roller pair 48.

The lower guide member 36 configures a portion of the main transport path K1 (see FIG. 1).

The transport roller 38 and the auxiliary roller 42 transport the medium P in the positive X direction while sandwiching the medium P therebetween, on the lower guide member.

The auxiliary paddle 44 is provided so as to be rotatable in the positive Z direction with respect to the processing tray 32, with the Y direction serving as an axial direction thereof. Further, the auxiliary paddle 44 is rotated and stopped by the auxiliary driving unit 46 that is configured to include a motor and a gear (not illustrated). The auxiliary paddle 44 feeds the medium P on the processing tray 32 in the positive A direction.

The delivery roller pair 48 delivers a media bundle Q (see FIG. 1) on the processing tray 32 toward the discharge tray 26 while rotating. The media bundle Q is a bundle of the plurality of media P on which the post-processing has been performed by the post-processing unit 80.

Figure 4:
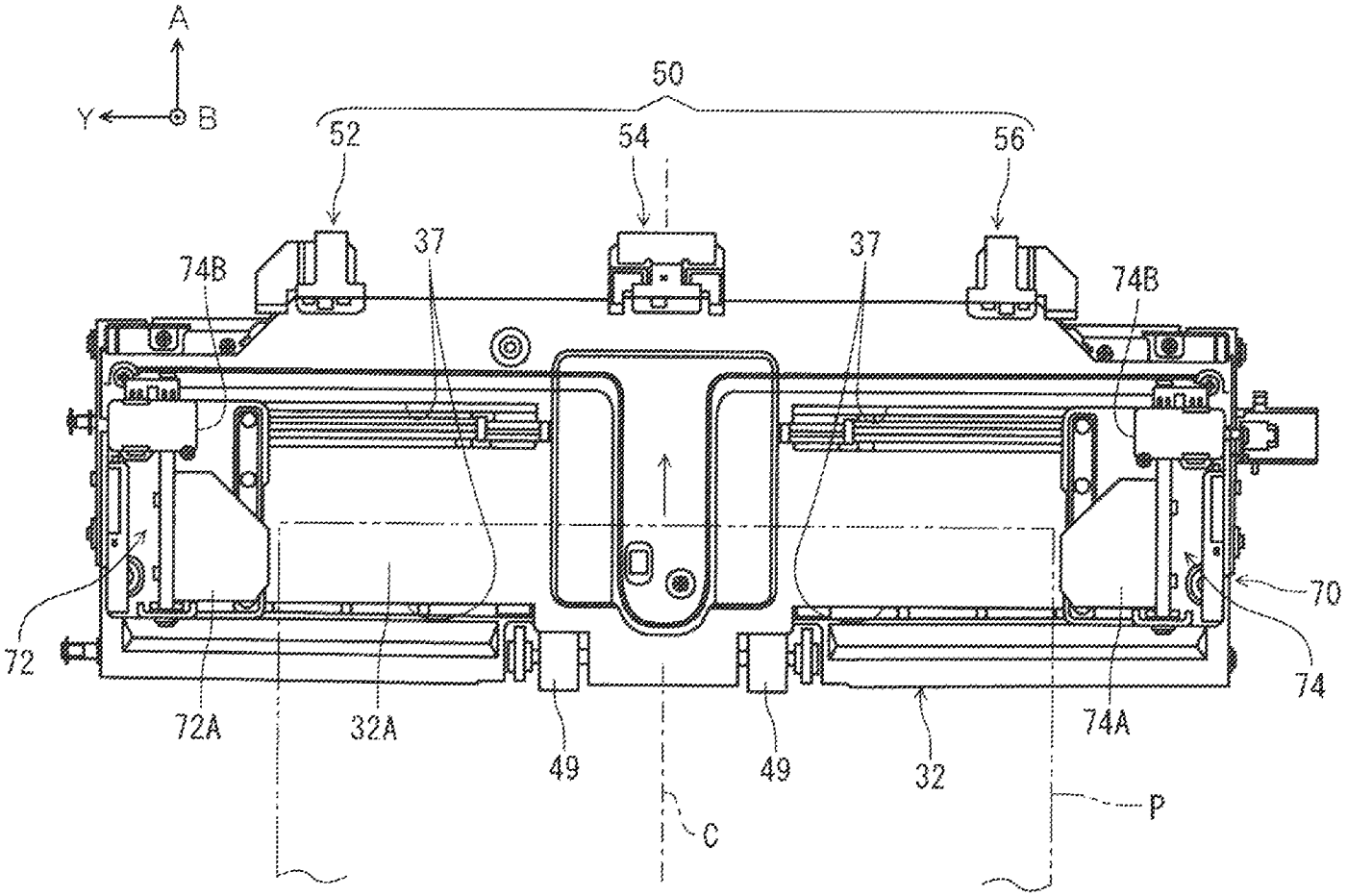
FIG. 4 is a plan view of the processing tray of the recording system according to the first embodiment.

As illustrated in FIG. 4, the processing tray 32 is an example of a placement unit, and is configured so that the media P on which the recording has been performed in the printer unit 10 (see FIG. 1) are placed and loaded thereon. Specifically, the processing tray 32 is formed in a flat plate shape extending in the A direction and the Y direction. Further, the processing tray 32 extends in the A direction so that an end portion thereof on the negative A direction side is positioned further in the positive Z direction than an end portion thereof on the positive A direction side. The width in the Y direction of the processing tray 32 is wider than the width in the Y direction of the medium P. Two sets of guide slits 37 extending in the Y direction are formed in the processing tray 32.

Here, as a result of the plurality of media P being sequentially placed on an upper surface 32A, which is a surface on the positive B direction side of the processing tray 32, that is, as a result of the plurality of media P being loaded in the positive B direction, the plurality of media P are accumulated on the processing tray 32, and the media bundle Q after the post-processing (FIG. 1) is formed.

As illustrated in FIG. 2, the paddle 34 is an example of a moving member, and moves the medium P that has been fed onto the processing tray 32 toward the alignment processing unit 50 to be described below.

Specifically, the paddle 34 is provided so as to be rotatable with the Y direction serving as an axial direction thereof, and the rotation center thereof is positioned between the processing tray 32 and the lower guide member 36 when viewed from the Y direction. Further, the paddle 34 has three blades 35, as an example.

Two sets of the three blades 35 are provided with an interval therebetween in the Y direction. Further, as an example, the three blades 35 are made of rubber and are formed in a rectangular plate shape having a predetermined thickness in the rotational direction.

The driving unit 40 is configured to include a motor (not illustrated), a gear (not illustrated), and the control unit 22 (FIG. 1) that controls the driving of the motor. Here, the driving unit 40 controls the rotation of the paddle 34, and as a result of the three blades 35 coming into contact with the medium P, the medium P on the processing tray 32 is fed into the alignment processing unit 50 to be described below.

As illustrated in FIG. 4, the alignment processing unit 50 is an example of a plurality of alignment units, and is provided at the end portion on the positive A direction side of the processing tray 32. Further, the alignment processing unit 50 aligns a downstream tip end downstream in the positive A direction of the medium P fed onto the processing tray 32. "Aligns" means to line up the ends of the media P in the B direction. Specifically, the alignment processing unit 50 includes an alignment unit 52, an alignment unit 54, and an alignment unit 56 that are disposed in the Y direction.

A virtual line indicating the center position in the Y direction of the processing tray 32 is referred to as a center line C. The center line C extends in the A direction.

The alignment unit 54 is positioned on the center line C. In other words, the alignment unit 54 is disposed in a central portion in the Y direction of the alignment processing unit 50. In the alignment unit 54, a portion on the positive Y direction side and a portion on the negative Y direction side are formed symmetrically with respect to the center line C.

The alignment unit 52 is an example of another of the alignment units, and is positioned on the positive Y direction side with respect to the alignment unit 54. The alignment unit 56 is an example of the other the alignment units, and is positioned on the negative Y direction side with respect to the alignment unit 54. In this way, the alignment unit 52, the alignment unit 54, and the alignment unit 56 are disposed symmetrically with respect to the center in the Y direction.

Figure 3:
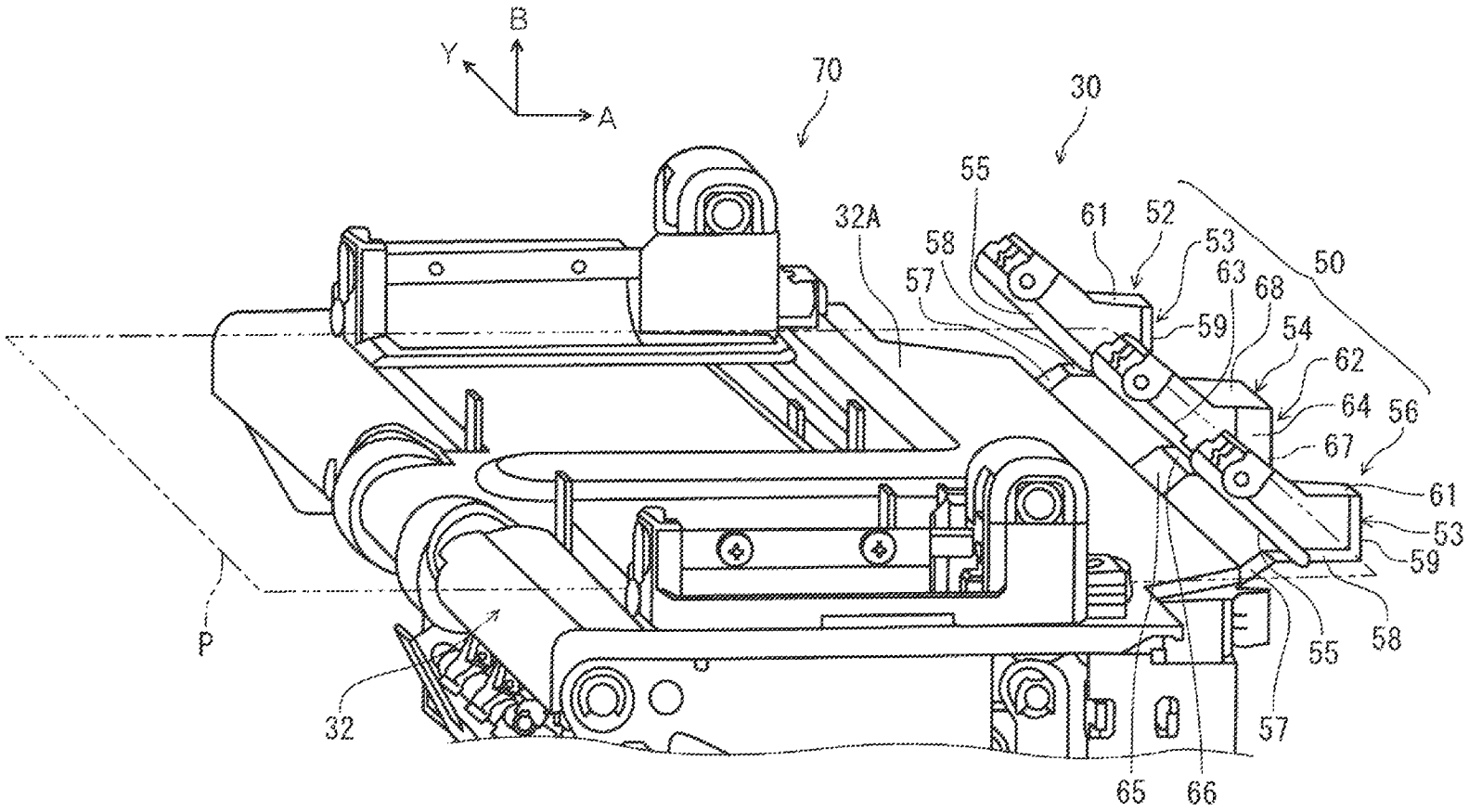
FIG. 3 is a perspective view illustrating the processing tray and peripheral portions of the recording system according to the first embodiment.

As illustrated in FIG. 3, the alignment unit 52 and the alignment unit 56 are fixed to the end portion on the positive A direction side of the processing tray 32. Note that the alignment unit 56 has a line-symmetrical configuration with that of the alignment unit 52, with the center line C (see FIG. 4) serving as an axis of symmetry. Thus, in the following description, a specific configuration of the alignment unit 52 will be described, portions of the alignment unit 56 will be denoted by the same reference signs as those of the alignment unit 52, and a description thereof will be omitted.

As an example, the alignment unit 52 includes a main body member 53 and a pressing member 55.

The main body member 53 is formed by a sheet metal bent at a plurality of locations, and opens in the negative A direction, as an example. Specifically, the main body member 53 includes a fixing portion 57, a lower plate portion 58, a vertical plate portion 59, and an upper plate portion 61.

The fixing portion 57 is fastened to the processing tray 32. The lower plate portion 58 extends in the positive A direction from the fixing portion 57. Further, an upper surface 58A (see FIG. 6) on the positive B direction side of the lower plate portion 58 is disposed so as to have substantially the same height as that of the upper surface 32A of the processing tray 32.

The vertical plate portion 59 is provided standing in the positive B direction from an end portion on the positive A direction side of the lower plate portion 58. The height of the vertical plate portion 59 in the positive B direction is set based on a maximum thickness of the media bundle Q (see FIG. 1). Further, by coming into contact with an end portion on the positive A direction side of the medium P or the media bundle Q, the vertical plate portion 59 aligns the end portion. A front face 59A (see FIG. 6) on the negative A direction side of the vertical plate portion 59 is a flat surface along a Y-B plane. The front face 59A is an example of a second alignment surface. Further, by coming into contact with end faces on the positive A direction side of the plurality of media P, the front face 59A aligns the end faces.

The upper plate portion 61 extends in the negative A direction from an end portion on the positive B direction side of the vertical plate portion 59. Further, an end portion on the negative A direction side of the upper plate portion 61 is disposed side by side with the end portion on the positive A direction side of the processing tray 32, in the B direction.

The pressing member 55 is formed in a plate shape when viewed from the Y direction. An end portion of the pressing member 55 on the negative A direction side is coupled to the end portion on the negative A direction side of the upper plate portion 61, so as to be rotatable with the Y direction serving as an axial direction thereof. An end portion on the positive A direction side of the pressing member 55 extends diagonally toward the vertical plate portion 59. In other words, the end portion on the positive A direction side of the pressing member 55 drops due to its own weight. Then, the pressing member 55 presses the medium P in the negative B direction to suppress floating of the medium P.

The alignment unit 54 is an example of one of the alignment units. Further, the alignment unit 54 is fixed to the processing tray 32. Specifically, the alignment unit 54 includes an attachment member 62, a pressing member 63, and a friction member 64.

The attachment member 62 is formed by a sheet metal bent at a plurality of locations, and opens in the negative A direction, as an example. The friction member 64 is attached to the attachment member 62. Specifically, the attachment member 62 includes a fixing portion 65, a lower plate portion 66, a vertical plate portion 67, and an upper plate portion 68.

The fixing portion 65 is fastened to the processing tray 32. The lower plate portion 66 extends in the positive A direction from the fixing portion 65. Further, an upper surface 66A (see FIG. 6) on the positive B direction side of the lower plate portion 66 is disposed so as to have substantially the same height as that of the upper surface 32A of the processing tray 32.

The vertical plate portion 67 is provided standing in the positive B direction from an end portion on the positive A direction side of the lower plate portion 66. The height of the vertical plate portion 67 in the positive B direction is set based on the maximum thickness of the media bundle Q (see FIG. 1) so that the vertical plate portion 67 can align the end portion of the media bundle Q. Further, the vertical plate portion 67 supports the friction member 64 to be described below with respect to the A direction, thereby assisting the function of aligning the end portion on the positive A direction side of the medium P or the media bundle Q. A front face 67A (see FIG. 6) on the negative A direction side of the vertical plate portion 67 is a flat surface along the Y-B plane.

The upper plate portion 68 extends in the negative A direction from an end portion on the positive B direction side of the vertical plate portion 67. Further, an end portion on the negative A direction side of the upper plate portion 68 is disposed side by side with the end portion on the positive A direction side of the processing tray 32, in the B direction.

The pressing member 63 is formed in a plate shape when viewed from the Y direction. An end portion of the pressing member 63 on the negative A direction side is coupled to the end portion on the negative A direction side of the upper plate portion 68, so as to be rotatable with the Y direction serving as an axial direction thereof. An end portion on the positive A direction side of the pressing member 63 extends diagonally toward the vertical plate portion 67. In other words, the end portion on the positive A direction side of the pressing member 55 drops due to its own weight. Then, the pressing member 63 presses the medium P in the negative B direction to suppress the floating of the medium P.

Figure 5:
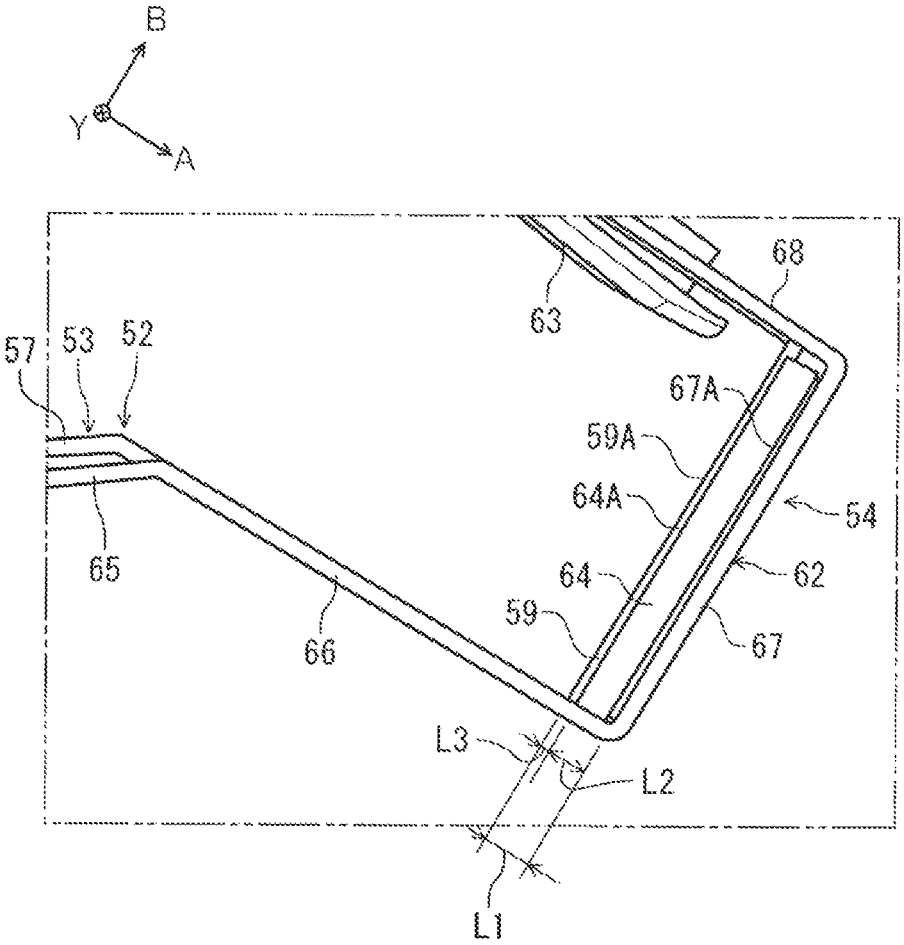
FIG. 5 is an enlarged side view of a portion of an alignment unit of the recording system according to the first embodiment.

As illustrated in FIG. 5, the height of the vertical plate portion 67 in the B direction is substantially the same as the height of the vertical plate portion 59 in the B direction. Further, the front face 67A is positioned downstream of the front faces 59A in the positive A direction. In other words, the front face 67A is disposed so as to be offset in the positive A direction with respect to the front face 59A. When viewed from the Y direction, a gap between the front face 59A and the front face 67A in the A direction is a length L1 (mm).

Figure 6:
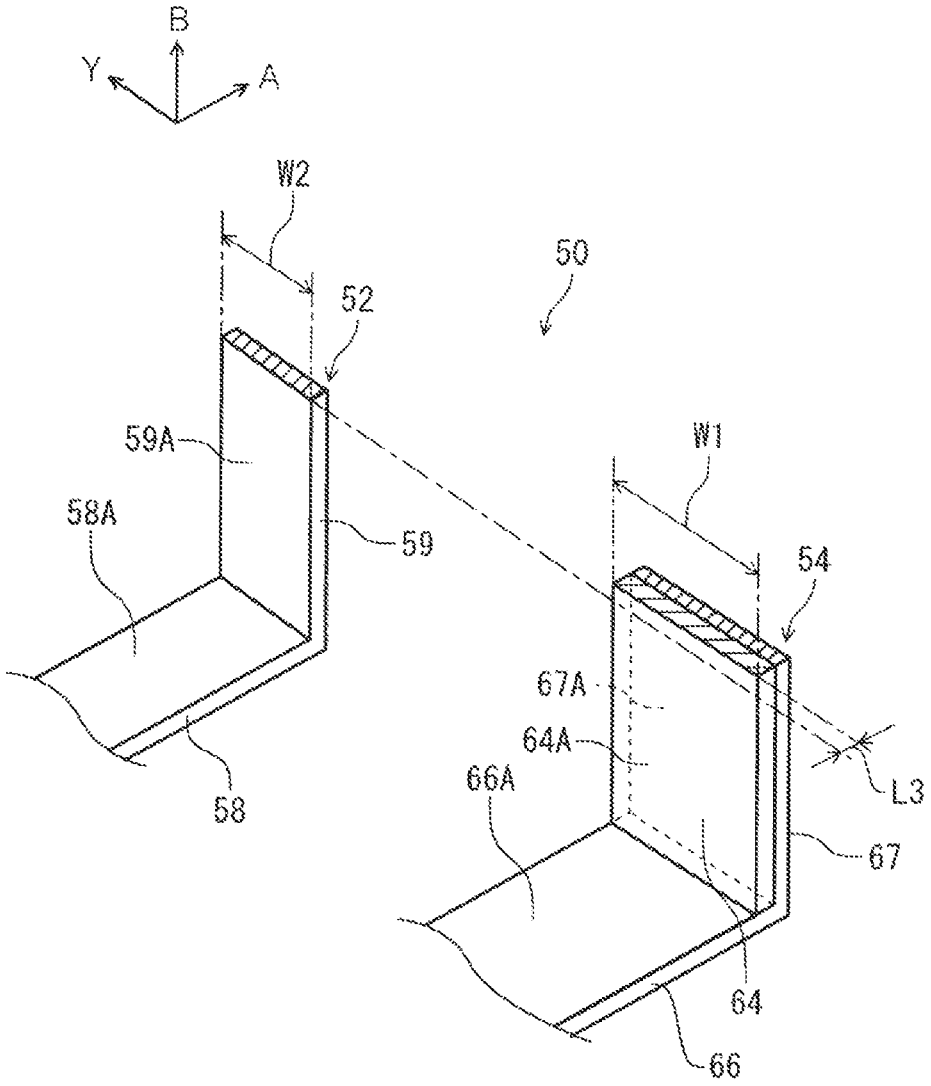
FIG. 6 is a perspective view of portions of the alignment units of the recording system according to the first embodiment.

As illustrated in FIG. 6, as an example, the friction member 64 includes cork and is formed in a flat plate shape having a predetermined thickness in the A direction. The outer shape of the friction member 64 is a rectangular shape whose dimension in the B direction is greater than a dimension thereof in the Y direction when viewed from the A direction. The width in the Y direction of the friction member 64 is approximately the same as the width in the Y direction of the vertical plate portion 67. The height of the friction member 64 in the B direction is lower than the height of the vertical plate portion 67 in the B direction.

Further, the friction member 64 has a contact surface 64A as an example of a first alignment surface. The contact surface 64A is a side face on the negative A direction side of the friction member 64, and, by coming into contact with the end faces on the positive A direction side of the plurality of media P, the contact surface 64A aligns the end faces. Further, the contact surface 64A is formed in a planar shape along the Y-B plane, as an example.

A coefficient of friction of the contact surface 64A obtained when it comes into contact with the medium P is higher than a coefficient of friction of the front face 59A obtained when it comes into contact with the medium P. In other words, a frictional force that acts on the medium P when the medium P is displaced in the negative B direction in a state in which the medium P is in contact with the contact surface 64A is larger than a frictional force that acts on the medium P when the medium P is displaced in the negative B direction in a state in which the medium P is in contact with the front face 59A.

Here, the width in the Y direction of the friction member 64 is W1 (mm). The width in the Y direction of the vertical plate portion 59 is W2 (mm). The width W1 is greater than the width W2, as an example.

As illustrated in FIG. 5, the contact surface 64A is positioned downstream of the front faces 59A in the positive A direction, and is positioned upstream of the front face 67A in the positive A direction. In other words, the contact surface 64A is disposed so as to be offset in the positive A direction with respect to the front face 59A, and is disposed on the negative A direction side with respect to the front face 67A.

Specifically, a length corresponding to the thickness in the A direction of the friction member 64 is L2 (mm). The length L2 is shorter than the length L1. Here, a length L3 (mm) =L1−L2. In other words, when viewed from the Y direction, the contact surface 64A is disposed so as to be offset in the positive A direction with respect to the front face 59A by the length L3.

As illustrated in FIG. 4, the side cursors 70 are an example of a displacement member and are provided on the processing tray 32. Then, the side cursors 70 displace the medium P on the processing tray 32 in the Y direction. Specifically, the side cursors 70 are configured by a first cursor 72 and a second cursor 74 positioned on both sides in the Y direction of the medium P.

The first cursor 72 includes a bottom plate portion 72A that supports a side portion on the positive Y direction side of the medium P, and a side plate portion 72B that holds the side portion from the side.

The second cursor 74 includes a bottom plate portion 74A that supports a side portion on the negative Y direction side of the medium P, and a side plate portion 74B that holds the side portion from the side.

A portion of the first cursor 72 and a portion of the second cursor 74 are respectively inserted into the guide slits 37 and are movable in the Y direction along the guide slits 37. Further, as an example, the first cursor 72 and the second cursor 74 can be automatically moved in the Y direction by being driven by a driving unit (not illustrated).

The first cursor 72 and the second cursor 74 align both end portions in the Y direction of the media P stacked on the processing tray 32. Further, the first cursor 72 and the second cursor 74 move in the positive Y direction or the negative Y direction with the media P or the media bundle Q sandwiched therebetween in the Y direction, thereby displacing the media P or the media bundle Q in the Y direction.

As illustrated in FIG. 1, the post-processing unit 80 performs the post-processing on the plurality of media P placed on the loading unit 30. Note that in this embodiment, "post-processing" means processing performed on the medium P on which the information has been recorded in the recording unit 2. Specifically, the post-processing unit 80 includes a stapler 82.

The stapler 82 is disposed on the positive A direction side of the processing tray 32. Further, the stapler 82 is movable in the Y direction by being driven by a motor (not illustrated). Furthermore, the stapler 82 is configured to perform end-binding processing on the aligned end portion on the positive A direction side of the media bundle Q, as a result of the control unit 22 controlling the operation. The end-binding processing is an example of post-processing.

Next, effects of the recording system 1 according to the first embodiment will be described.

Figure 7:
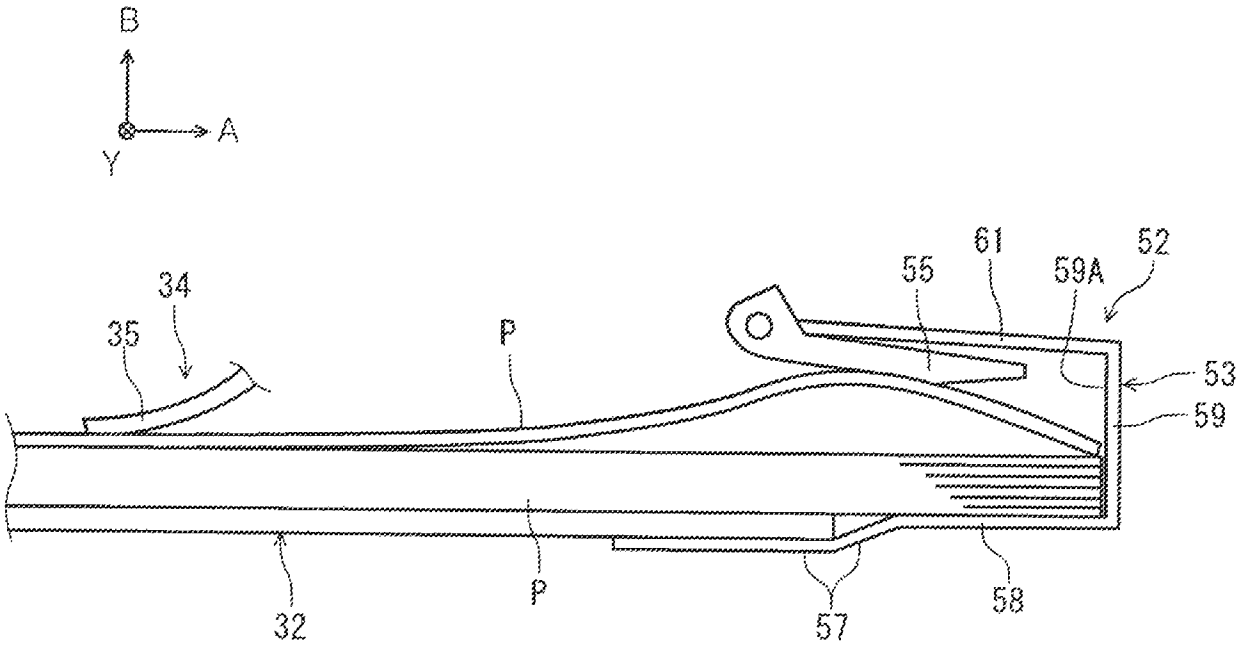
FIG. 7 is a schematic view illustrating a state in which a medium on the processing tray of the recording system according to the first embodiment is being aligned.

As illustrated in FIG. 7, a description will be given of a case in which the other medium P is further fed in the positive A direction by the paddle 34 in a state in which the plurality of media P are stacked and placed on the processing tray 32 and the lower plate portion 58. Note that in FIG. 7, only the alignment unit 52 is illustrated, and the alignment unit 54 and the alignment unit 56 are omitted and not illustrated.

Figure 8:
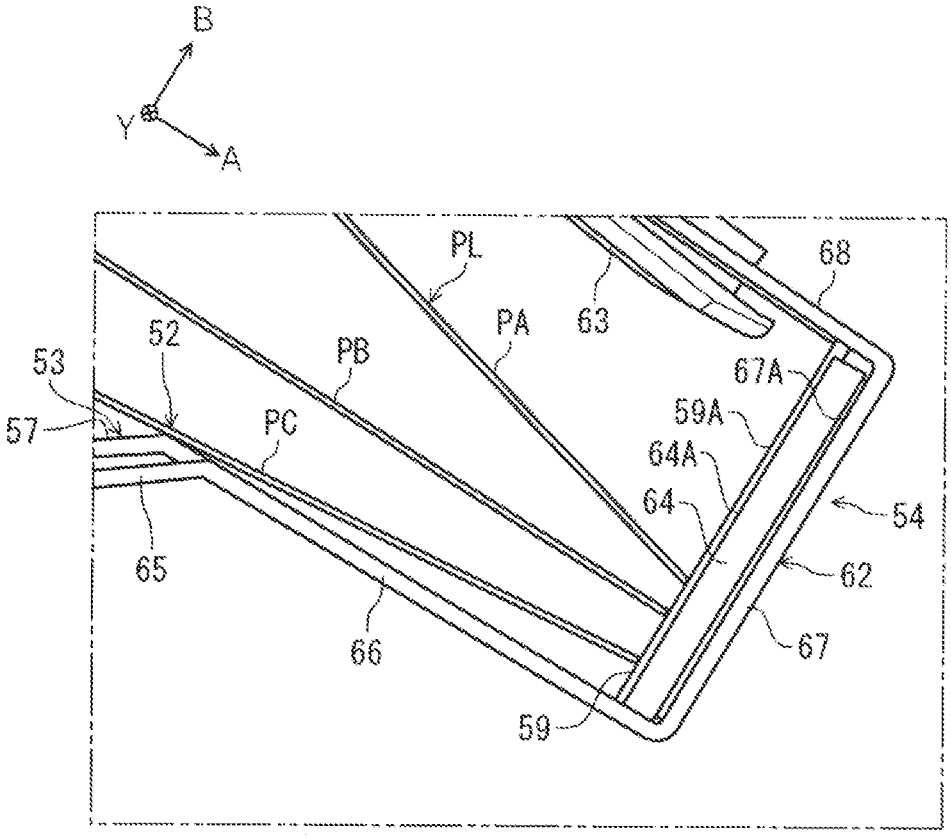
FIG. 8 is a schematic view illustrating a state in which a tip portion of the medium comes into contact with the alignment unit of the recording system according to the first embodiment at different angles.

In FIG. 8, a state is illustrated in which a medium PL on which a relatively low amount of ink is used at a time of recording is fed toward the alignment unit 52 and the alignment unit 54. Note that the alignment unit 56 (see FIG. 4) is omitted and not illustrated in FIG. 8.

With the medium PL, since a degree of swelling of the medium PL due to impregnation of the ink is low, an occurrence of curling of the medium PL, and a decrease in rigidity of the medium PL with respect to a force acting in the A direction are suppressed. Thus, as indicated by reference signs PA, PB, and PC, even when a feed angle of a tip portion of the medium PL moving toward the alignment unit 52 and the alignment unit 54 varies in a direction intersecting the A direction, the tip portion of the medium PL is inhibited from entering a gap between the tip portion of the already placed medium P, and the alignment unit 52 and the alignment unit 54.

Figure 9:
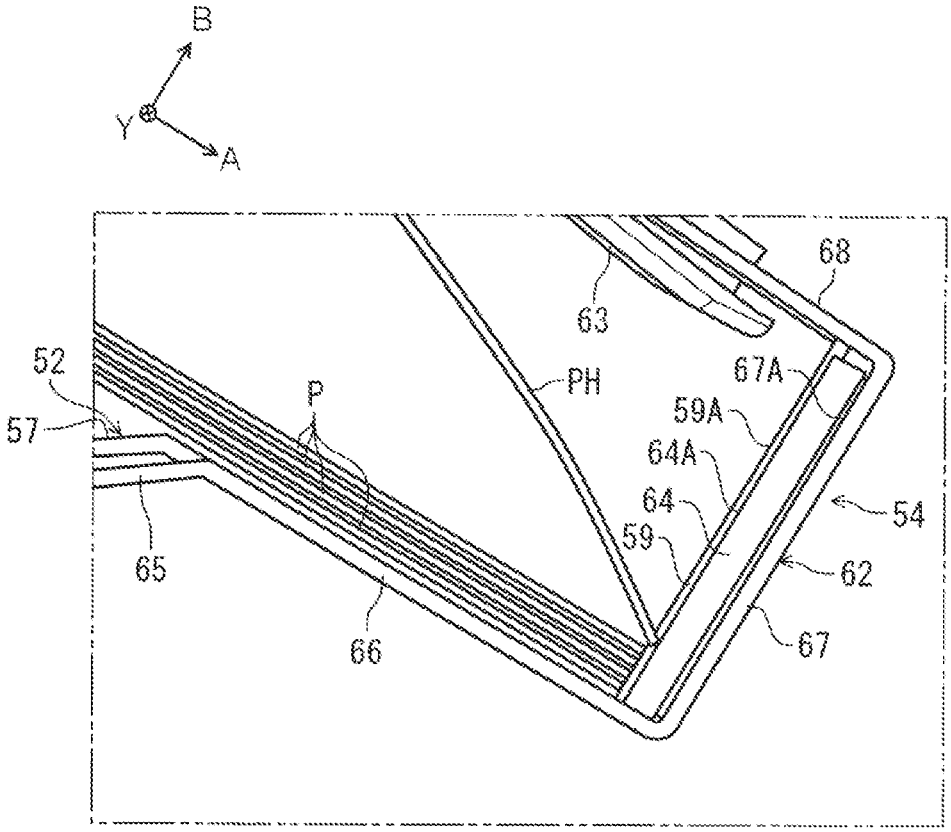
FIG. 9 is a schematic view illustrating a state in which the tip portion of the medium in a bent state comes into contact with the alignment units of the recording system according to the first embodiment.

FIG. 9 illustrates a state in which a medium PH on which a relatively large amount of ink is used at a time of recording is fed toward the alignment unit 52 and the alignment unit 54. Note that the alignment unit 56 (see FIG. 4) is omitted and not illustrated in FIG. 8. Further, the plurality of media P are already loaded under the medium PH.

With the medium PH, since the degree of swelling of the medium PH due to the impregnation of the ink is high, there is a possibility that curling of the medium PH may occur, or rigidity of the medium PH with respect to the force acting in the A direction may decrease. As a result, there is a possibility that the feed angle of a tip portion of the medium PH moving toward the alignment unit 52 and the alignment unit 54 may increase in the direction intersecting the A direction.

Figure 10:
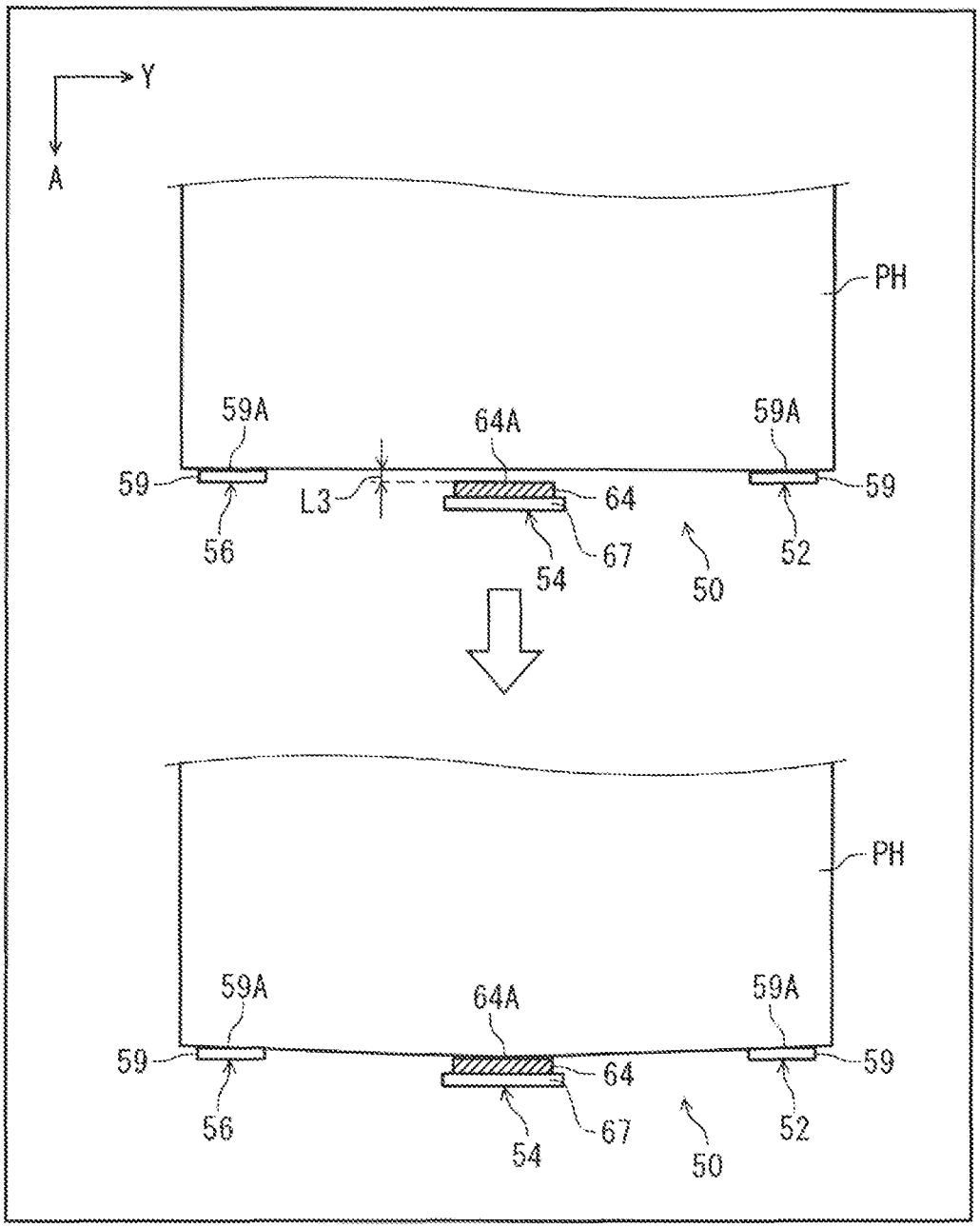
FIG. 10 is a plan view illustrating a state in which the tip portion of the medium comes into contact with a plurality of the alignment units in the recording system according to the first embodiment.

As illustrated in an upper diagram of FIG. 10, both end portions in the Y direction of the tip portion, on the positive A direction side, of the medium PH, which has been fed into the alignment processing unit 50, come into contact with the vertical plate portions 59. At the time of the contact, since the friction member 64 is disposed so as to be offset in the positive A direction with respect to the vertical plate portions 59, a central portion in the Y direction of the medium PH is not in contact with the friction member 64.

Subsequently, as illustrated in a lower diagram of FIG. 10, when the feeding of the medium PH in the positive A direction is continued even after both the end portions in the Y direction of the medium PH have come into contact with the vertical plate portions 59, the central portion in the Y direction of the medium PH comes into contact with the friction member 64. Here, when the central portion in the Y direction of the medium PH attempts to move in the negative B direction, since a coefficient of friction of the friction member 64 is high, a relatively large frictional force acts on the medium PH, and thus, the movement of the tip portion on the positive A direction side of the medium PH in the negative B direction is restricted. In other words, the tip portion on the positive A direction side of the medium PH is inhibited from entering the gap between the tip portion on the positive A direction side of the already loaded medium P, and the alignment units 52, 54 and 56.

Note that the plurality of loaded media P and the medium PH are post-processed by the post-processing unit 80 (see FIG. 1), and become the media bundle Q.

Figure 11:
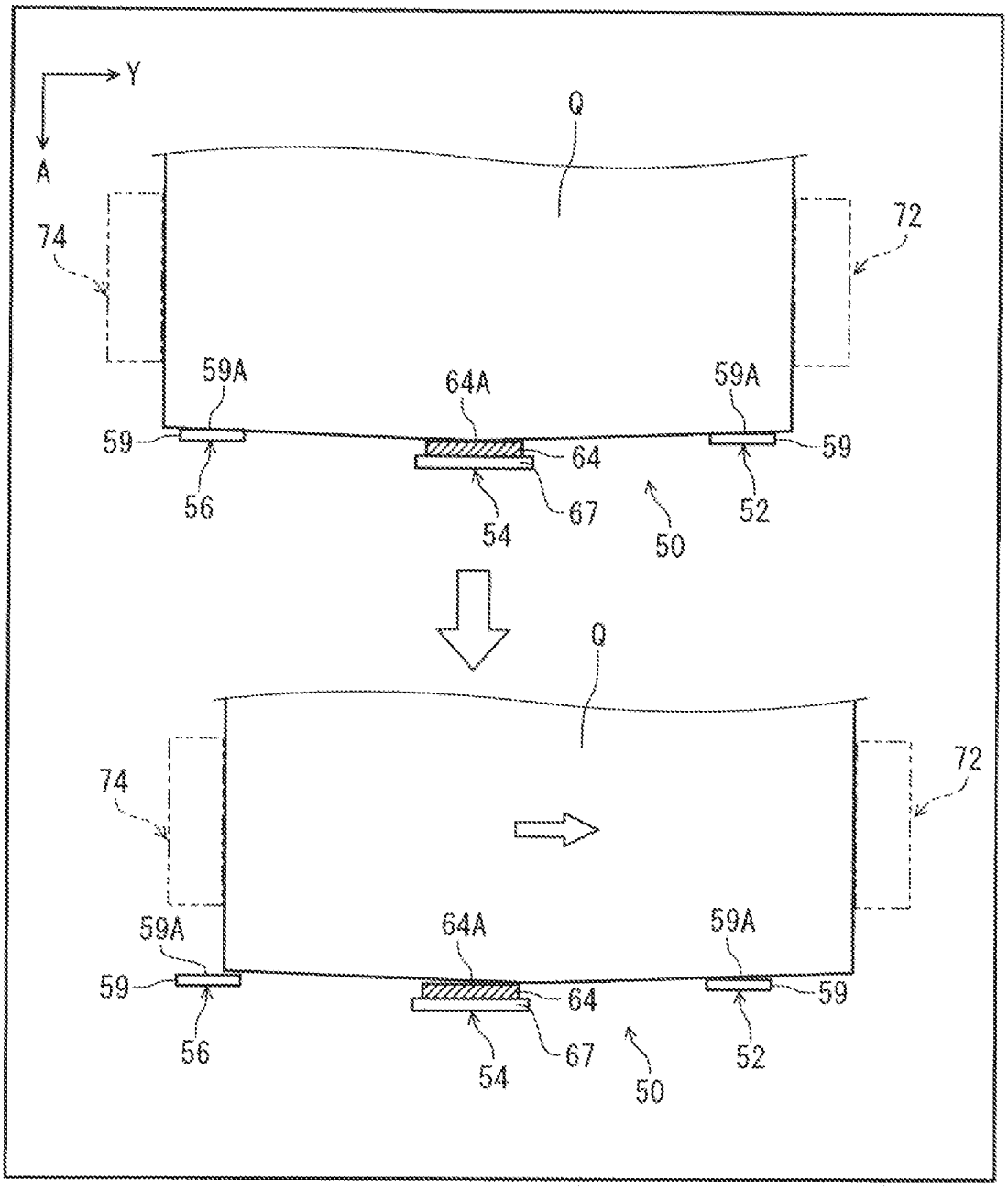
FIG. 11 is a plan view illustrating a state in which the tip portion of the medium comes into contact with the plurality of alignment units in the recording system according to the first embodiment, and is then shifted in the width direction.

As illustrated in an upper diagram of FIG. 11, the post-processed media bundle Q is sandwiched by the first cursor 72 and the second cursor 74 in the Y direction.

Subsequently, as illustrated in a lower diagram of FIG. 11, as a result of the first cursor 72 and the second cursor 74 being moved in the positive Y direction, the media bundle Q is moved in the positive Y direction. Here, the contact surface 64A of the friction member 64 is disposed so as to be offset in the positive A direction with respect to the front faces 59A of the vertical plate portions 59. Thus, the tip portion on the positive A direction side of the media bundle Q is not likely to come into contact with the contact surface 64A while being moved in the positive A direction. As a result, it is possible to inhibit the movement of the media bundle Q in the positive A direction from being restricted by the friction member 64.

Note that, here, although an operation of shifting the media bundle Q after the post-processing is described, the same applies to an operation of shifting the plurality of media P before the post-processing is performed thereon.

While referring to FIG. 1 to FIG. 11, actions and effects of the loading unit 30 and the post-processing unit 3 will be summarized.

According to the loading unit 30, the paddle 34 moves the medium P, which has been fed onto the processing tray 32, toward the alignment units 52, 54, and 56. In a state in which at least one of the media P is placed on the processing tray 32, when the other medium P in a bent state is fed onto the processing tray 32, since the alignment units 52 and 56 are positioned upstream of the alignment unit 54 in the positive A direction, the medium P comes into contact with the alignment units 52 and 56, and the downstream tip end of the medium P is aligned.

Subsequently, a portion of the downstream tip end in the positive A direction of the medium P, which is not in contact with the front face 59A, is deformed toward the downstream side in the positive A direction, and at the same time, the portion attempts to move toward the processing tray 32 due to its own weight.

Here, since the downstream tip end of the medium P comes into contact with the alignment unit 54 positioned downstream of the alignment units 52 and 56, the movement of the medium P toward the downstream is restricted. Furthermore, since the coefficient of friction of the contact surface 64A is higher than the coefficient of friction of the front faces 59A, the movement of the downstream tip end of the medium P toward the processing tray 32 is restricted. As a result, the downstream tip end of the other medium P is inhibited from entering the gap between the downstream tip end of the already loaded medium P, and the alignment units 52, 54, and 56. Thus, when the other medium P in a bent state is fed onto the processing tray 32, it is possible to inhibit the alignment of the end portion of the already loaded medium P from becoming disordered.

Further, when the plurality of media P are displaced in the Y direction in a state in which the plurality of media P are loaded on the processing tray 32, since the contact surface 64A having the high coefficient of friction is positioned downstream of the front faces 59A having the low coefficient of friction, the plurality of media P are not likely to come into contact with the contact surface 64A. As a result, when the plurality of media P are displaced in the Y direction, it is possible to inhibit a load caused by sliding between the plurality of media P and the alignment unit 54 from increasing.

According to the loading unit 30, the alignment units 52, 54, and 56 are disposed symmetrically with respect to the center in the Y direction. As a result, at the tip portions on the positive A direction side of the plurality of media P, the alignment units 52, 54, and 56 uniformly come into contact with the tip portions on both sides thereof with respect to the center in the Y direction. Thus, in the processing tray 32, it is possible to inhibit the plurality of media P from being loaded while being inclined with respect to the positive A direction.

According to the loading unit 30, when the medium P is fed onto the processing tray 32, portions near both the end portions in the Y direction of the medium P come into contact with the alignment units 52 and 56 before portions closer to the central portion thereof. Thus, in the processing tray 32, it is possible to further inhibit the plurality of media P from being loaded while being inclined with respect to the positive A direction.

According to the loading unit 30, when the contact surface 64A is worn, it is sufficient that only the friction member 64 be replaced. In other words, since it is not necessary to replace the entire alignment unit 54, an amount of material to be disposed of when replacing the contact surface 64A can be reduced.

According to the loading unit 30, when the side cursors 70 displace the medium P in the Y direction, the contact surface 64A having the high coefficient of friction does not move in the negative Y direction, which is a displacement direction of the medium P and the opposite direction to the positive Y direction. Thus, a sliding resistance acting on a contact portion between the medium P and the contact surface 64A can be reduced.

According to the post-processing unit 3, similarly to the loading unit 30, when the other medium P in a bent state is fed onto the processing tray 32, it is possible to inhibit the alignment of the end portions of the already loaded media P from becoming disordered. Furthermore, when the plurality of media P are displaced in the Y direction, it is possible to inhibit a load caused by sliding between the plurality of media P and the alignment units 52, 54, and 56 from increasing. Due to these effects, an aligned state of the plurality of media P loaded on the processing tray 32 is unlikely to become disordered, and it is thus possible to make it easier for the post-processing unit 80 to perform the post-processing on the plurality of media P.

Note that according to the post-processing unit 3, each of the above-described actions and effects of the loading unit 30 can be obtained.

Second Embodiment

Next, a recording device, a medium loading device, and a post-processing device according to a second embodiment of the present disclosure will be described mainly with reference to FIG. 12.

Figure 12:
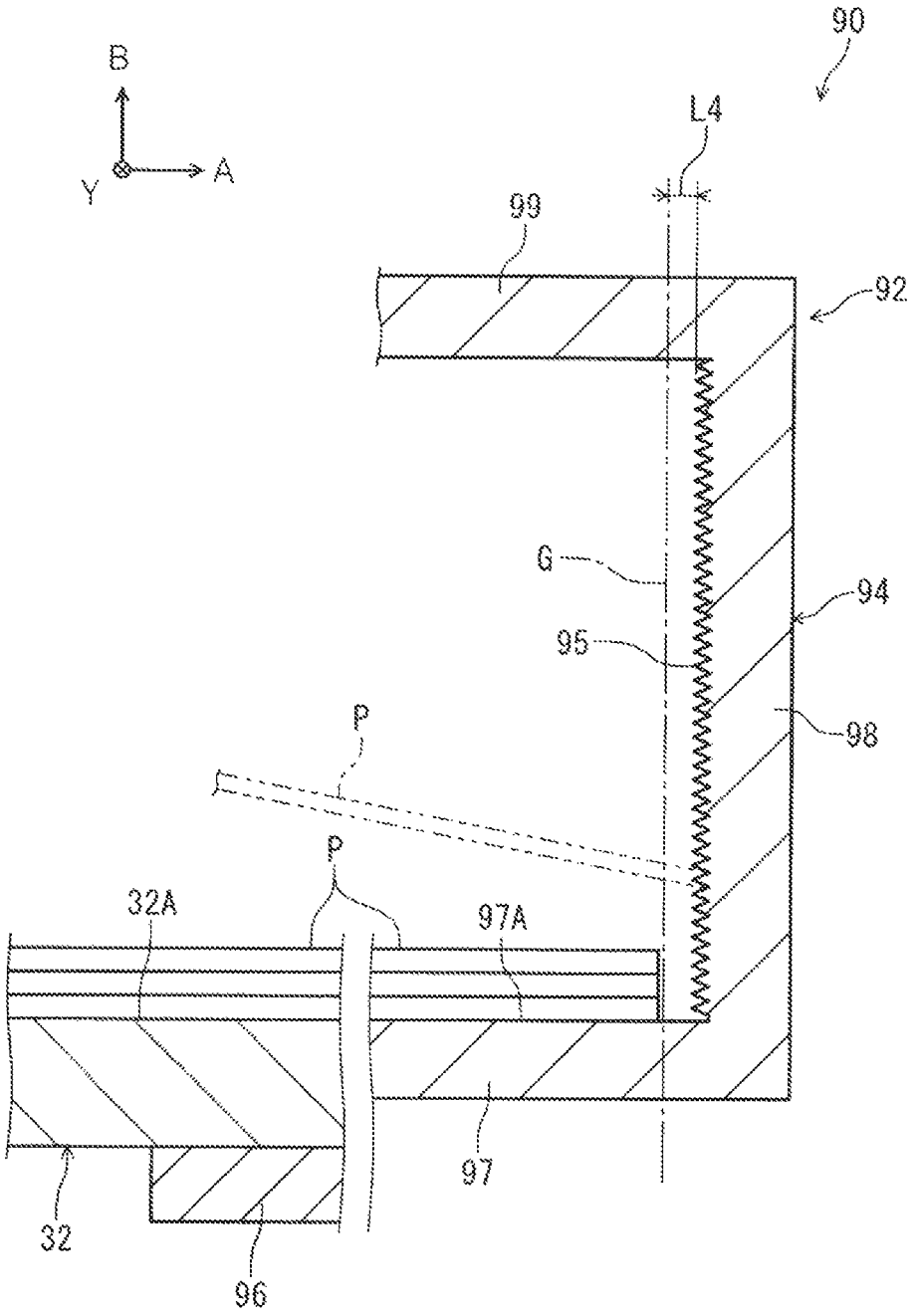
FIG. 12 is a plan view illustrating a state in which the tip portion of the medium comes into contact with an alignment unit in the recording system according to a second embodiment.

In FIG. 12, a portion of a loading unit 90 is illustrated as an example of the medium loading device. The loading unit 90 is provided in the post-processing unit 3 (see FIG. 1) in place of the loading unit 30 (see FIG. 1). In the post-processing unit 3 according to the second embodiment, a configuration other than the loading unit 90 is the same as the configuration of the first embodiment, and a description thereof will thus be omitted.

Further, the loading unit 90 is configured to include an alignment unit 92 in place of the alignment unit 54 (see FIG. 3) provided in the loading unit 30. A configuration other than the alignment unit 92 is the same as that of the loading unit 30, and a description thereof will be thus omitted while assigning the same reference signs to the common components.

The alignment unit 92 is an example of the one of the alignment units. Further, the alignment unit 92 is fixed to the processing tray 32. Furthermore, the alignment unit 92 is positioned on the center line C (see FIG. 4). In other words, the alignment unit 92 is disposed in the center portion in the Y direction of the alignment processing unit 50 (see FIG. 4). Further, the alignment unit 92 is formed so that a portion thereof on the positive Y direction side and a portion thereof on the negative Y direction side are formed symmetrically with respect to the center line C. Specifically, the alignment unit 92 includes a contact member 94, a contact surface 95, and the pressing member 63 (see FIG. 3).

The contact member 94 is an example of an alignment unit main body. Further, as an example, the contact member 94 is formed of a stainless steel sheet metal that is bent at a plurality of locations, and opens in the negative A direction. Specifically, the contact member 94 includes a fixing portion 96, a lower plate portion 97, a vertical plate portion 98, and an upper plate portion 99.

The fixing portion 96 is fastened to the processing tray 32. The lower plate portion 97 extends in the positive A direction from the fixing portion 96. Further, an upper surface 97A of the lower plate portion 97 on the positive B direction side is disposed so as to have approximately the same height as that of the upper surface 32A.

The vertical plate portion 98 is provided standing in the positive B direction from an end portion on the positive A direction side of the lower plate portion 97. The height of the vertical plate portion 98 in the positive B direction is set based on a maximum thickness of the media bundle Q (see FIG. 1) so as to be able to align the end portion of the media bundle Q. Further, the height of the vertical plate portion 98 in the positive B direction is approximately the same as the height of the vertical plate portion 59 (see FIG. 6) in the positive B direction. The width in the Y direction of the vertical plate portion 98 is greater than the width W2 (see FIG. 6) described above. Further, by coming into contact with the end portions on the positive A direction side of the media P and the media bundle Q, the vertical plate portion 59 aligns the end portions.

The upper plate portion 99 extends in the negative A direction from an end portion on the positive B direction side of the vertical plate portion 98. Further, an end portion on the negative A direction side of the upper plate portion 99 is disposed side by side with the end portion on the positive A direction side of the processing tray 32, in the B direction.

The contact surface 95 is an example of the first alignment surface, and is formed in a portion, on the negative A direction side of the vertical plate portion 98, which comes into contact with the medium P. Further, as an example, the contact surface 95 is formed by roughening the surface of the vertical plate portion 98. Note that in FIG. 12, the shape of the contact surface 95 is simplified and illustrated by triangular projections and depressions, but the actual contact surface 95 is configured as a surface including minute projections and depressions having irregular sizes and shapes.

The contact surface 95 is positioned downstream in the positive A direction of a virtual line G that indicates the position of the front face 59A (see FIG. 6) in the A direction. In other words, the contact surface 95 is disposed so as to be offset in the positive A direction with respect to the front face 59A. When viewed from the Y direction, a length corresponding to an interval in the A direction between the virtual line G and the contact surface 95 is L4 (mm). The length L4 is approximately the same as the length L3 (see FIG. 6). The outer shape of the contact surface 95 is a rectangular shape whose dimension in the B direction is greater than a dimension thereof in the Y direction when viewed from the A direction.

The contact surface 95 is a portion having a higher coefficient of friction than other portions of the contact member 94. Further, a coefficient of friction of the contact surface 95 obtained when it comes into contact with the medium P is higher than the coefficient of friction of the front face 59A (see FIG. 6) obtained when it comes into contact with the medium P. In other words, a frictional force acting on the medium P when the medium P is displaced in the negative B direction in a state in which the medium P is in contact with the front face 59A is larger than a frictional force acting on the medium P when the medium P is displaced in the negative B direction in a state in which the medium P is in contact with the contact surface 95.

Next, effects of the loading unit 90 according to the second embodiment will be described. Note that the actions and effects of the recording system 1 and the post-processing unit 3 are the same as those of the first embodiment, and a description thereof will thus be omitted.

When the feeding of the medium P in the positive A direction is continued even after both the end portions of the medium P in the Y direction have come into contact with the front faces 59A (see FIG. 6), the central portion in the Y direction of the medium P comes into contact with the contact surface 95. Here, when the central portion in the Y direction of the medium P attempts to move in the negative B direction, since the coefficient of friction of the contact surface 95 is high, a relatively large frictional force acts on the medium P, and thus the movement, in the negative B direction, of the tip portion on the positive A direction side of the medium P is restricted. In other words, the tip portion on the positive A direction side of the medium P is inhibited from entering the gap between the tip portion on the positive A direction side of the already loaded medium P and the alignment units 52, 92, and 56.

Here, according to the loading unit 90, it is not necessary to configure the entire alignment unit 92 with a member having a high coefficient of friction, and it is sufficient that the contact surface 95 be formed by the surface roughening processing, which is post-processing. Thus, it is possible to prevent portions other than the contact surface 95 from unnecessarily having a high coefficient of friction.

The recording system 1, the post-processing unit 3, and the loading unit 30 and the loading unit 90 according to the embodiments of the present disclosure are based on the configurations described above, but as a matter of course, modifications, omissions, and the like may be made to a partial configuration thereof without departing from the gist of the disclosure of the present application.

Figure 13:
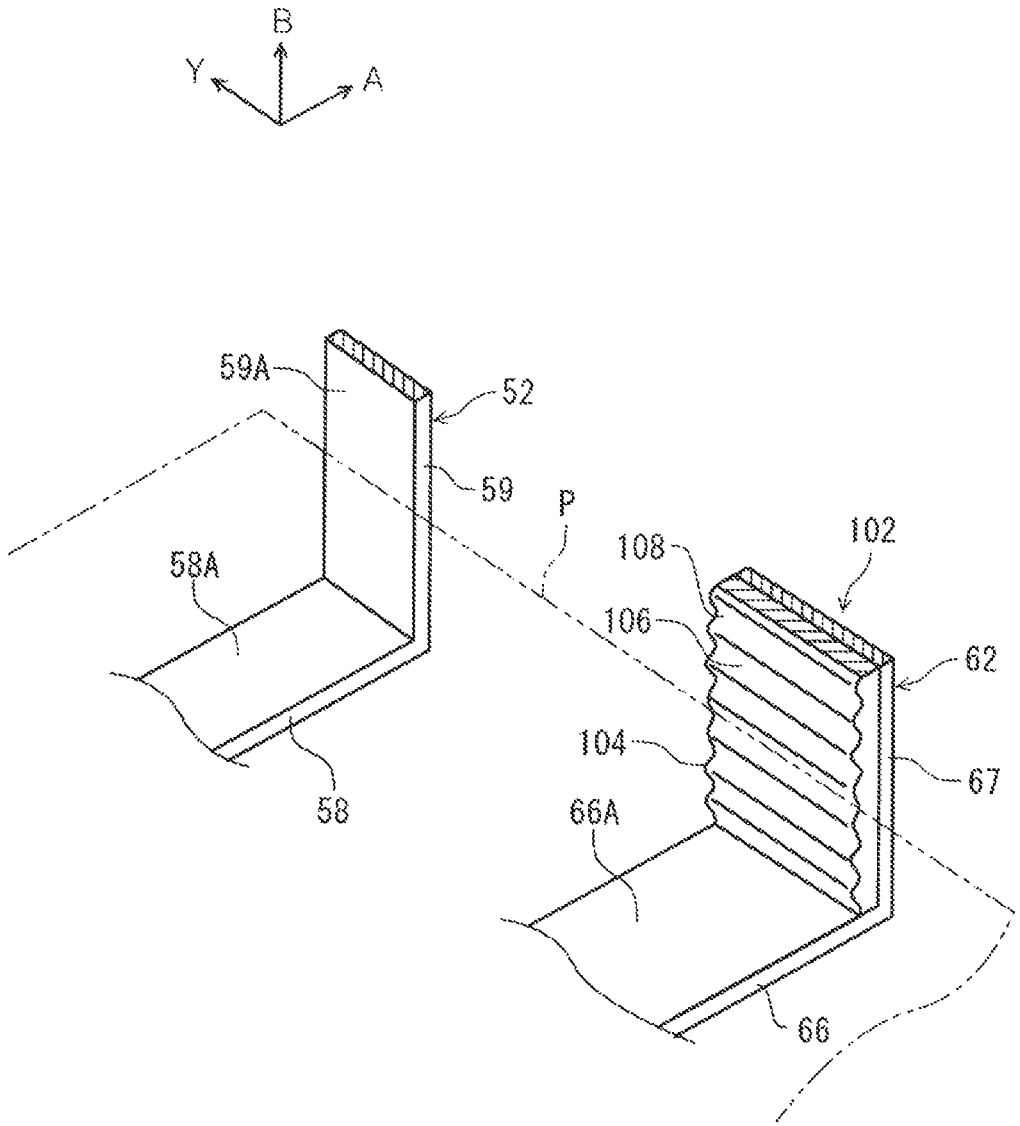
FIG. 13 is a perspective view of an alignment unit according to a modified example of the first embodiment.

In FIG. 13, an alignment unit 102 is illustrated as a modified example of the alignment unit 54 (see FIG. 3). Note that since the alignment unit 52 and the alignment unit 56 (see FIG. 3) are the same as those in the first embodiment, a description thereof will be omitted. Further, with regard to a configuration identical to that of the first embodiment, a description thereof will be omitted while assigning the same reference signs to the common components.

The alignment unit 102 is an example of the one of the alignment units. Further, the alignment unit 102 is fixed to the processing tray 32 (see FIG. 3). Specifically, the alignment unit 102 includes the attachment member 62, the pressing member 63 (see FIG. 3), and a friction member 104.

As an example, the friction member 104 is a member formed into a plate shape having a predetermined thickness in the A direction, and is attached to the front face 67A (see FIG. 6) of the vertical plate portion 67. The outer shape of the friction member 104 is a rectangular shape whose dimension in the B direction is greater than a dimension thereof in the Y direction when viewed from the A direction. The width in the Y direction of the friction member 104 is substantially the same as the width in the Y direction of the vertical plate portion 67. The height of the friction member 104 in the B direction is lower than the height of the vertical plate portion 67 in the B direction.

Further, the friction member 104 has a contact surface 106 as an example of the first alignment surface. The contact surface 106 is positioned downstream of the front faces 59A in the positive A direction. Further, the contact surface 106 is a side face on the negative A direction side of the friction member 104, and by coming into contact with the end faces on the positive A direction side of the plurality of media P, the contact surface 106 aligns the end faces. A plurality of lateral grooves 108 are formed in the contact surface 106. Note that in FIG. 13, in order to make it easier to understand a configuration of the lateral grooves 108, projections and depressions of the plurality of lateral grooves 108 are illustrated in an enlarged manner.

The lateral grooves 108 are open in the negative A direction and extend along the Y direction. Further, the lateral grooves 108 are formed as valley portions of the projections and depressions, in which ridge portions and the valley portions are repeatedly formed in the B direction when viewed from the Y direction, and each have a curved wall surface. The shape and size of a cross section, along an A-B plane, of each of the lateral grooves 108 is substantially the same shape and size in the Y direction. The plurality of lateral grooves 108 are disposed side by side in the B direction.

A coefficient of friction of the contact surface 106 obtained when it comes into contact with the medium P is higher than the coefficient of friction of the front faces 59A obtained when they come into contact with the medium P. Further, although the projections and depressions are repeated in the B direction in the contact surface 106, projections and depressions are not formed in the Y direction. In other words, the contact surface 106 is formed so that a coefficient of friction obtained when it comes into contact with the medium P in the B direction is higher than a coefficient of friction obtained when it comes into contact with the medium P in the Y direction. In this way, the coefficient of friction of the contact surface 106 is higher than the coefficient of friction of the front faces 59A at least in the B direction.

In the alignment unit 102, a coefficient of friction in the B direction is higher than a coefficient of friction in the Y direction. As a result, the downstream tip end of the medium P is inhibited from entering the gap between the downstream tip end of the already loaded medium P and the alignment units 52, 102, and 56. Thus, when the medium P in a bent state is fed onto the processing tray 32 (see FIG. 3), it is possible to inhibit the alignment of the end portions of the already loaded media P from becoming disordered.

Further, since the contact surface 106 is positioned downstream, in the positive A direction, of the front faces 59A having the low coefficient of friction, the plurality of media P are not likely to come into contact with the contact surface 106.

Here, when the plurality of media A are displaced in the Y direction in the state in which the plurality of media P are loaded on the processing tray 32, even if the medium P and the contact surface 106 come into contact with each other, since the coefficient of friction of the contact surface 106 in the Y direction is lower than the coefficient of friction thereof in the B direction, it is possible to inhibit a load caused by sliding between the plurality of media P and the alignment unit 102 from increasing.

In this manner, the coefficient of friction of the contact surface 106 in the B direction, which is a loading direction of the medium P, may be increased, and at the same time, the coefficient of friction of the contact surface 106 in the Y direction, which is the displacement direction of the medium P, may be set to be lower than the coefficient of friction thereof in the B direction.

Further, similarly to the contact surface 95 (see FIG. 12), the contact surface 106 may be formed by directly performing the surface roughening processing on the contact surface.

In the loading unit 30, the alignment units 52, 54, and 56 need not necessarily be disposed symmetrically with respect to the center in the Y direction.

Either the alignment unit 52 on the positive Y direction side or the alignment unit 54 on the negative Y direction side may not be disposed in the loading unit 30.

In the loading unit 30, the side cursors 70 need not necessarily be provided. Further, the alignment unit 54 may be provided such that the position thereof can be changed in the Y direction with respect to the processing tray 32.

The number of the plurality of alignment units is not limited to three, and may be two, or four or more.

The widths in the Y direction of the alignment units 52 and 56 may be different from each other. Further, the alignment units 52 and 56 may be movable in the Y direction, and only the alignment unit 54 may be fixed to the processing tray 32.

In a configuration provided with a plurality of the alignment units 54, the widths in the Y direction of the plurality of friction members 64 may be different from each other.

The thickness in the A direction of the friction member 64 need not necessarily be the same in the B direction, but may vary in the B direction. Note that when the thickness in the A direction of the friction member 64 varies in the B direction, the contact surface 64A is not limited to being a continuous inclined surface or curved surface when viewed from the Y direction. For example, the contact surface 64A may be a stepped uneven surface when viewed from the Y direction.

Similarly, the contact surface 95 may be one of the inclined surface, the curved surface, and the stepped uneven surface when viewed from the Y direction.

The post-processing is not limited to the end-binding processing, and may be other processing such as punching processing performed on the plurality of media P.

What is claimed is:

1. A medium loading device comprising:

a placement unit at which a medium processed by a processing unit is placed;

a plurality of alignment units disposed at an interval in a width direction intersecting a feeding direction of the medium to the placement unit, and configured to align a downstream tip end in the feeding direction of the medium fed to the placement unit; and a moving member configured to move, toward the plurality of alignment units, the medium fed to the placement unit, wherein a coefficient of friction of a first alignment surface of one of the plurality of alignment units is higher than a coefficient of friction of a second alignment surface of another one of the plurality of alignment units, the first alignment surface and the second alignment surface being configured to align the medium, and the first alignment surface is positioned downstream of the second alignment surface in the feeding direction.

2. The medium loading device according to claim 1, wherein the coefficient of friction of the first alignment surface is higher than the coefficient of friction of the second alignment surface in a loading direction of the medium.

3. The medium loading device according to claim 2, wherein the coefficient of friction of the first alignment surface is higher than the coefficient of friction of the second alignment surface in the width direction.

4. The medium loading device according to claim 2, wherein one of the alignment units includes a friction member including the first alignment surface, and an attachment member to which the friction member is attached.

5. The medium loading device according to claim 3, wherein one of the alignment units includes a friction member including the first alignment surface, and an attachment member to which the friction member is attached.

6. The medium loading device according to claim 5, wherein a dimension of the friction member in the loading direction is longer than a dimension of the friction member in the width direction when viewed from the feeding direction.

7. The medium loading device according to claim 6, wherein the friction member includes cork.

8. The medium loading device according to claim 2, wherein a dimension of the first alignment surface in the width direction is longer than a dimension of the second alignment surface in the width direction when viewed from the feeding direction.

9. The medium loading device according to claim 1, wherein the plurality of alignment units are disposed symmetrically with respect to a center in the width direction.

10. The medium loading device according to claim 9, wherein one of the alignment units is disposed in a central portion in the width direction, and another one of the alignment units is disposed on one side and another side, in the width direction, of the one of the alignment units.

11. The medium loading device according to claim 2, wherein one of the alignment units includes an alignment unit main body, and the first alignment surface that has a higher coefficient of friction than that of the alignment unit main body and is formed at a portion, of the alignment unit main body, that comes into contact with the medium.

12. The medium loading device according to claim 1, wherein the placement unit includes a displacement member that displaces the medium in the width direction, and at least one of the plurality of alignment units is fixed to the placement unit.

13. A post-processing device comprising:

the medium loading device according to claim 1; and a post-processing unit configured to perform post-processing on a plurality of the media placed at the placement unit.

14. The post-processing device according to claim 13, wherein a dimension of the friction member in the loading direction is longer than a dimension of the friction member in the width direction when viewed from the feeding direction.

15. The post-processing device according to claim 14, wherein a dimension of the first alignment surface in the width direction is longer than a dimension of the second alignment surface in the width direction when viewed from the feeding direction.

16. The post-processing device according to claim 13, wherein the plurality of alignment units are disposed symmetrically with respect to a center in the width direction.

17. The post-processing device according to claim 16, wherein one of the alignment units is disposed in a central portion in the width direction, and another one of the alignment units is disposed on one side and another side, in the width direction, of the one of the alignment units.

18. The post-processing device according to claim 13, wherein one of the alignment units includes a friction member including the first alignment surface, and an attachment member to which the friction member is attached.

19. The post-processing device according to claim 13, wherein one of the alignment units includes an alignment unit main body, and the first alignment surface that has a higher coefficient of friction than that of the alignment unit main body and is formed at a portion, of the alignment unit main body, that comes into contact with the medium.

20. The post-processing device according to claim 13, wherein the placement unit includes a displacement member that displaces the medium in the width direction, and at least one of the plurality of alignment units is fixed to the placement unit.

* * * * *